United States Patent [19]

Murphy et al.

[11] Patent Number: 5,056,433

[45] Date of Patent: Oct. 15, 1991

[54] INK TRAY WITH DISPERSION CHANNELS

[75] Inventors: Charles F. Murphy, Fairfield, Conn.; Jerome E. Jackson, Newtown, N.Y.; Danilo P. Buan, Easton, Conn.

[73] Assignee: Pitney Bowes Inc., Stamford, Conn.

[21] Appl. No.: 533,306

[22] Filed: Jun. 4, 1990

[51] Int. Cl.[5] ..... B41F 1/42; B41G 27/04

[52] U.S. Cl. ..... 101/364; 101/103

[58] Field of Search ..... 101/287, 293, 294, 295, 101/301, 302, 303, 304, 310, 318, 324, 327, 333, 335, 97, 98, 101, 103, 104, 202, 210, 364; 118/109

[56] References Cited

U.S. PATENT DOCUMENTS 2,756,674 7/1956 Rieger et al. ..... 101/301
3,804,016 4/1974 Marozzi ..... 101/333
4,484,827 11/1984 Price ..... 101/335
4,694,747 9/1987 Marozzi ..... 101/301

*Primary Examiner*—J. Reed Fisher

[57] ABSTRACT

An ink tray has been improved to include a plurality of channel ribs formed on the bottom surface. The rib ends are spaced apart from the ink tray side walls. An ink pad is supported in the ink tray above the channels such that ink directed through the channels is absorbed by the ink pad. Replenishing ink is directed into the ink tray and caused to collect at one end of a first group of channel ribs and thereafter uniformly between each channel rib of the first group. The displaced ink is then caused to uniformly travel between a second group of channel ribs and exit the ink tray. The travel path of the ink allows for even absorption of ink by the ink pad and the removal of excess ink from the ink tray.

7 Claims, 4 Drawing Sheets

INK TRAY WITH DISPERSION CHANNELS

BACKGROUND OF THE INVENTION

The present invention relates to a ink tray for applying ink to a printing plate.

In flat-bed postage meter mailing machine, it is conventional for a mailing machine to receive envelopes in a seriatim manner from a feeding apparatus. The mailing machine includes a postage meter which has a indicia printing plate. The mailing machine also includes a system for reinking the postage meter printing plate. It is conventional for the reinking system to include a reinking roller which is wiped across the postage meter indicia printing plate for transferring ink to the indicia printing plate. The postage meter indicia printing plate is reinked in this manner after each printing cycle. The reinking roller is replenished at its home position receiving replenishing ink from a reservoir through one or more intermediate ink transfer rollers. Reinking occurs after each print cycle to assure consistent print quality.

Pursuant to an effort to improve the envelope throughput speed while maintaining or improving the print quality of flat-bed postage meter mailing machine, an identified limiting factor is the time required to reink the indicia print plate. The duration of a wipe cycle time, i.e., reinking the indicia print plate, is dependent on the ink transfer properties of the wipe roller and the distance of travel required for the reinking roller to completely traverse the postage meter indicia plate. The travel distance is substantially increased when an indicia printing plate includes an advertisement slogan as well as a postage indicia.

It has been determined that an ink pad application system employing an ink tray sized matting to the indicia plate and positionable laterally from a home position to a position abutting the indicia plate face provides a consistent travel distance independent of indicia date size. However, one of the difficulties in employing ink pad systems in a postage meter mailing machine environment is providing a renewable source of ink to the ink pad in such a manner to assure even and regulated adsorption of ink throughout the ink pad in a manner suitable for high speed continuous mail processing applications.

SUMMARY OF THE INVENTION

It is an objective of the present invention to present an ink tray for holding an ink pad and providing the ink tray with means of receiving and dispersing ink supplied by a source evenly throughout the ink absorbance area of the ink pad. It is a further objective of the present invention to present an ink tray suited to receive a sufficient amount of replenishing ink for reinking an indicia plate having a advertisement slogan and postage indicia, and having means for discharging excess ink should the advertisement slogan be absent. It is a still further objective of the present invention to present an ink tray having means for maintaining the level of ink absorption of an ink pad. It is still another objective to present an ink tray having ink pad supports for positioning of the ink pad to prevent shifting or buckling of the ink pad transfer surface.

The ink tray includes to one side an inlet conduit which leads to a reservoir formed by the bottom and side walls of the ink tray and an outlet or drain conduit spaced apart from the inlet conduit. A plurality of ribs are formed in the ink tray and are disbursed generally uniformly therein. The ribs are aligned such that they are spaced apart from the back wall and forward wall of the ink tray and such that ink delivered to the ink reservoir is caused to collect evenly along the back wall isolated from the ink pad before dispersing forwardly as a result capillary action between the ribs to the forward wall. The outlet portion of the ink pad has a negative pressure applied thereto to assist in removing excess ink from the tray. The ink pad is placed in the ink tray elevated above the bottom of the ink tray supported by the ribs. Replenishing ink is thereby uniformly accessible to absorption area of the ink pad. The absorption level of the ink pad is maintained constant by providing a affirmative means for draining excess ink from the ink tray.

DETAILED DESCRIPTION OF THE INVENTION

Figure 1:
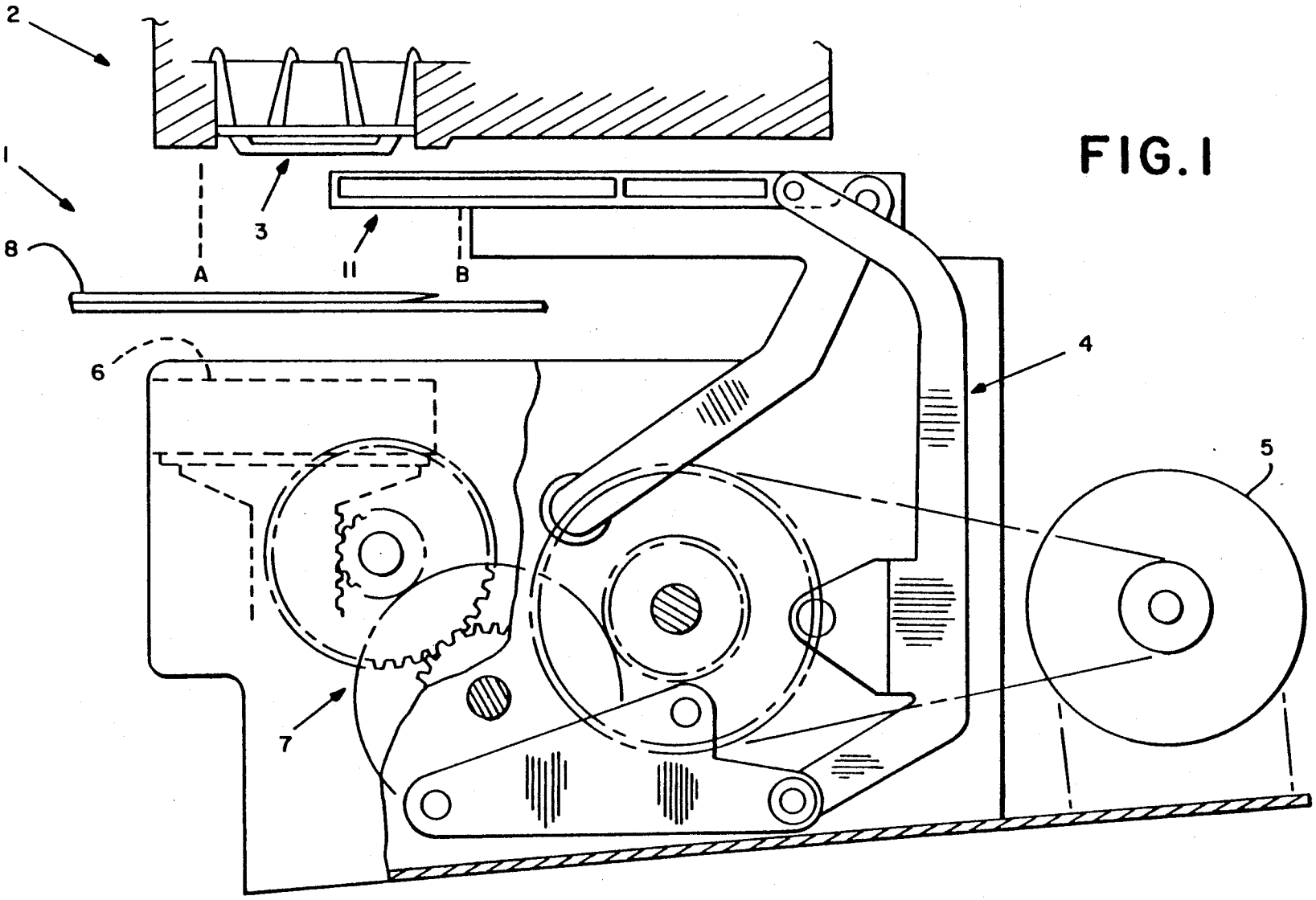
FIG. 1 is a partial side sectional view of a postage meter mailing machine having an ink tray assembly for reinking the indicia printing plate of the postage meter in accordance with the present invention.

Referring to FIG. 1, a suitable postage meter mailing machine, generally indicated as 1, includes a postage meter, generally indicated as 2. The postage meter 2 includes an indicia printing plate 3. An ink tray 11 is supported by a support assembly 4 which is positionable by a motor 5 longitudinally between a first position "A" and a second position "B". At the longitudinal position "A", the motor 5 causes the ink tray 11 to displace vertically to contact the indicia printing plate 3 prior to returning to the home position at position "B". During contact between the indicia plate 3 and ink tray 11, printing ink is transferred to the indicia plate 3. Following inking of the indicia printing plate 3, a platen 6 is caused by a drive system 7 to raise an envelope 8 into contact with the indicia printing plate 3 resulting in printing of a postage indicia on the envelope 8. Copending U.S. patent application Ser. No. 366,113, filed on July 21, 1989 now abandoned in favor of U.S. patent application Ser. No. 526,954, filed May 23, 1990, herein incorporated by reference, more fully describes the position of the ink tray by motor 5.

Figure 2:
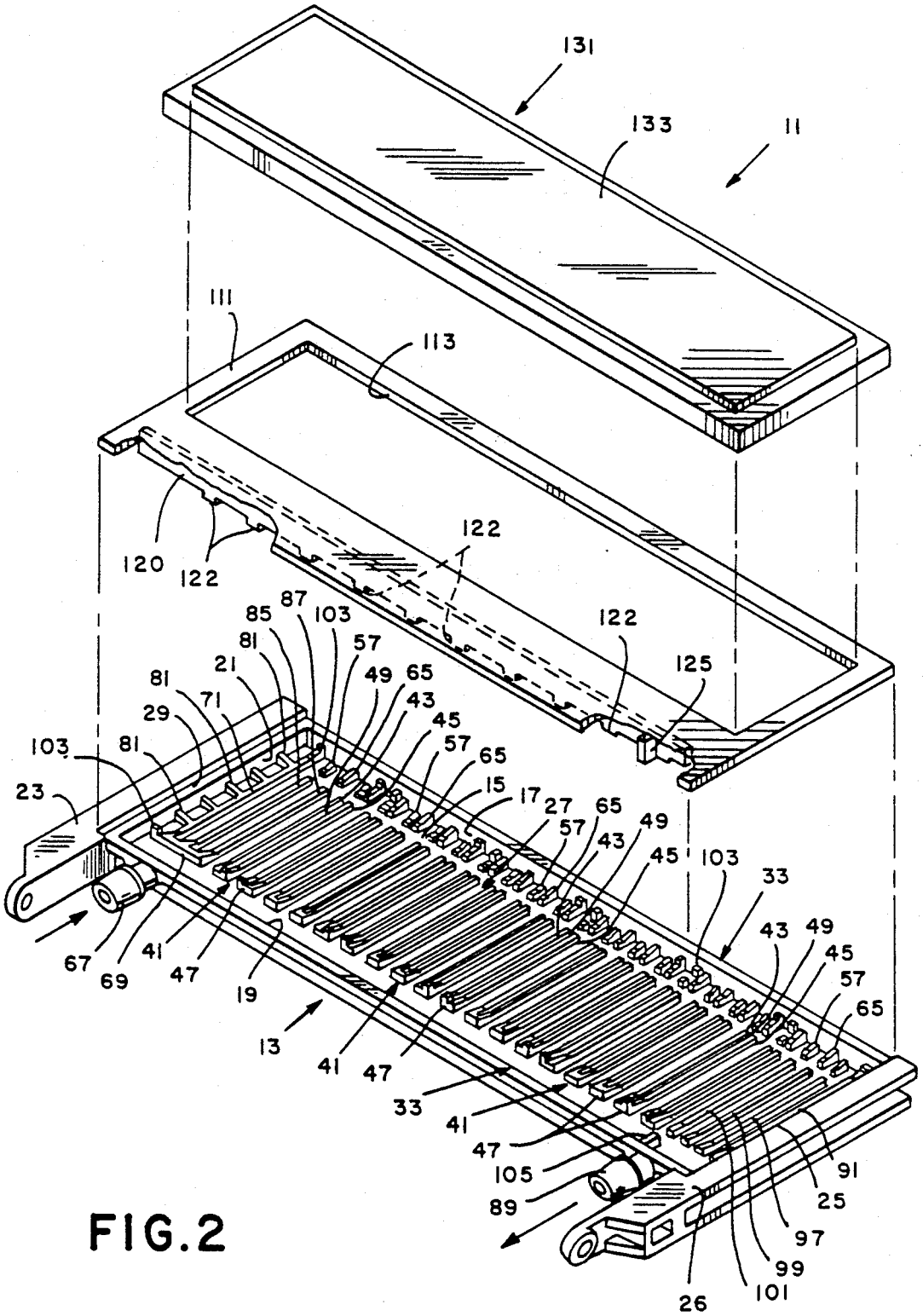
FIG. 2 is a exploited view of an ink tray in accordance with the present invention.
Figure 3:
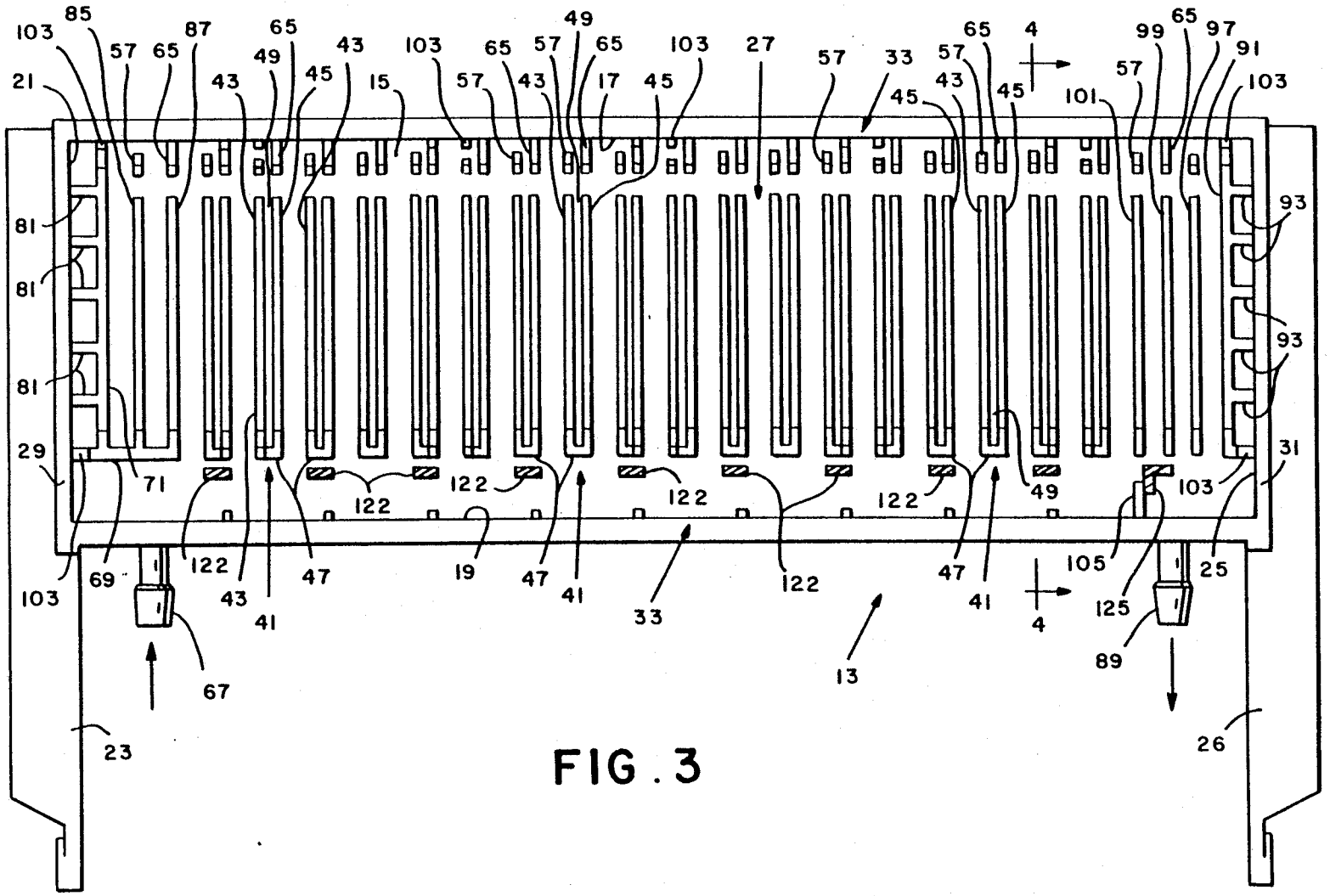
FIG. 3 is a top view of the ink tray housing.

Referring to FIGS. 2 and 3, the ink tray 11 is comprised of a housing 13 having a bottom surface 15, a front wall 17 and rear wall 19. The front wall 17 and rear wall 19 are formed to an equal height above the bottom surface 15. Side walls 21 and 25 are mounted to the bottom surface having respective rearwardly extending mounting arms 23 and 26. The front wall 17 and rear wall 19 in combination with the side walls 21 and 25 form a reservoir 27.

Formed partially along the side wall 21 is a ridge 29 of equal height to the front wall 17 and rear wall 19. In like manner, a ridge 31 is formed partly along the inner surface of the side wall 25. The top portion of the front wall 17 and the rear wall 19 in combination with the ridge 29 and 31 form a rim 33.

A plurality of ribs 41 are formed within the reservoir 27 to the bottom surface 15. The ribs 41 are uniformly spaced between the back wall 19 and front wall 17. Each rib 41 is comprised of elongated ribs 43 and 45, and a short rib 47 joining the long ribs 43 and 45 at one end to form a generally U-shaped channel rib 49 open at the forward end. The U-shape of rib 49 was chosen as a matter of convenience and does offer some additional benefit. The channel ribs 49 are configured to have an upward ramp at the closed end.

Alternating along the interior of the forward wall 17 are a plurality of short upwardly ramped ribs 57 and upwardly ramped end ribs 65. The short rib 57 is slightly spaced apart from the interior of the front wall 17. The short rib 57 is also space apart and opposite the first rib 43. The end rib 65 is spaced and opposite the rib portion 45 at one end and in communication with the interior of the front wall 17 at its other end.

An inlet conduit 67 is formed to the inlet side of the ink tray housing 13. Opposite the inlet conduit 67 Within the reservoir 27 is a blocking rib 69 in communication with the interior of side wall 21 at one end. A rib 71 extends from blocking rib 69 to the forward wall 17. A plurality of spaced apart and upwardly sloped ribs 81 extend between the side wall 21 and the rib 71. Extending forwardly from the blocking ribs 69 are ribs 85 and 87. A short rib 57 is spaced opposite rib 85 and a rib 65 is spaced opposite the rib 87.

An outlet conduit 89 is formed to the outlet side of the ink tray housing 13. Opposite the side wall 25 is a end rib 91 spaced apart from the side wall 25. A plurality of spaced apart and upwardly sloped ribs 93 extend between the side wall 25 to the rib 91 Formed endwardly from the end wall 91 in spaced apart relationship are ribs 97, 99 and 101, respectively.

Formed to extend vertically from selected ribs is a positioning nibbles 103. A plurality of positioning nibbles 103 are also formed in spaced relationship along the interior of walls 17, 21 and 25.

Figure 4:
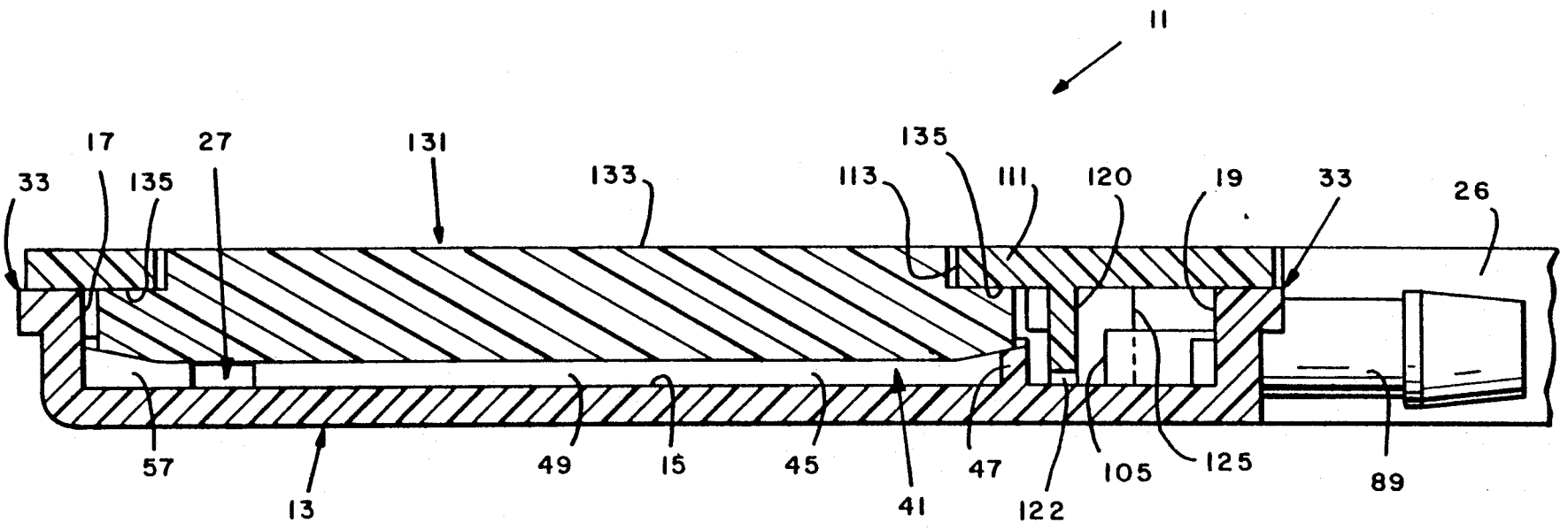
FIG. 4 is a sectional end view of the ink tray along line 4—4 of FIG. 3.

Referring more particularly to FIGS. 2 and 4, a top 111 has an opening 113. The top 111 is sized to be received by the rim 33 formed in the housing 13 and fixably mounted thereto. A baffle plate 120 extends along the underside portion of the top 111. The baffle plate 120 includes a plurality of downwardly extending and longitudinally spaced apart baffling niches or studs 122 which are aligned with the short ribs 47. The top 111 also includes a flow brake or containment wall 125 which is aligned with flow brake 105 formed in the housing 1.

The top 111 is fitted onto the ink tray such that the baffle plate 120 provide vertical support for the top along with rim 33. The studs 122 of baffle plate 120 are in proximate contact with the bottom surface 15, the top is maintained at a consistent height. The studs 122 of baffle plate 120 are positioned opposite to the short ribs 47. The configuration provides passage ways between the baffle plate 120.

An ink pad 131 made of ink absorbing material is sized to be and is positioned through an opening 113 in top 111 such that an edge portion 132 of the ink pad 131 is trapped between the top 111 and ribs 41. A upper portion 133 of the pad extends through the opening 113 to be flush with respect to the upper surface of top 111. The ink pad is held in spaced relationship to walls 17, 21, 25 and baffle plate 120 and supported vertically by ribs 41. In this manner, the ink pad is securely positioned. The nibbles 103 permitted sufficient expansion when the ink pad is ink absorbed to prevent surface distortion.

It can now be observed that ink which is supplied in the inlet conduit 67 is caused to change flow direction when encountering the blocking rib 69 to flow within the area between the end of the ribs 41 and the back wall 19. As the ink fills the vacant space and then encounters the flow brake 105 and 125, the ink then journeys along the passage way as a result of capillary action between adjacent ribs 41 to be received in the upper sections of the forward sections of the ink tray. It is observed that the ink is isolated from the ink pad until the ink tray is suitable supplied. A negative pressure is applied to the outlet conduit 89. By this flow, ink is evenly distributed along the bottom of the well to be absorbed by the ink pad. It is observed that the negative pressure allows the ink to be replenished and excess ink to be withdrawn in a manner such that the ink tray maintains a constant ink flow height. The ribs formed along the side wall 21 and 25 and 17 raised end configuration has been empirically formed to control the deflection shape of the ink pad upon contact with an indicia plate to result in controlled ink diffusion within the ink pad.

Thereby the distribution system disclosed allows the ink pad to be evenly supplied with ink and prevents spillage of the ink from the sides of the ink pad due to indicia impact and excess amounts of ink supplied to the ink tray due to the absence of an advertisement slogan indicia during inking of the indicia print.

What is claimed is:

1. An improved ink tray having a plurality of housing side walls and a bottom surface defining a ink well for receiving printing ink and having means for supporting a ink pad in said ink tray above said ink well, wherein said improvement comprises:

a plurality of channel ribs formed on said bottom surface, said channel ribs at their respective ends being spaced apart from first and second ones of said side walls, said first and second side walls being aligned opposite to each other;

a top fixably mounted to said ink tray and having an opening aligned above said ink well;

a first baffle formed to the underside of said top in contact with said bottom surface and extending generally parallel to and spaced apart from said first wall, said first baffle having a plurality of formed laterally spaced apart studs;

inlet means for supplying ink to said ink tray through said first well at a first end of said ink tray;

outlet means for removing excess ink from said ink tray through said first wall at a second end of said ink tray;

a flow brake formed in said ink tray between said first wall and said first baffle such that ink introduced to said ink well through said inlet means is directed between said studs in said first baffle and between said channel ribs located to one side of said flow brake and therefrom along said second wall and between said channel ribs located to the other side of said flow brake to said outlet means.

2. An improved ink tray as claimed in claim 1 further including positioning nibbles means for maintaining the position of said ink pad in spaced relationship to said side walls and said first baffle.

3. An improved ink tray as claimed in claim 1 or 2 further including means for restricting absorption of ink by said ink pad.

4. An improved ink tray having a plurality of housing side walls and a bottom surface defining a ink well for receiving printing ink and having means for supporting an ink pad in said ink tray above said ink well, wherein said improvement comprises:

a plurality of first channel ribs having a generally U-shaped configuration formed on said bottom surface, said channel ribs at their respective ends being spaced apart from first and second ones of said side walls, said first and second side walls being aligned opposite to each other;

a top fixably mounted to said ink tray and having an opening aligned above said ink well;

a first baffle formed to the underside of said top in contact with said bottom surface and extending generally parallel to and spaced apart from said first wall, said first baffle having a plurality of formed laterally spaced apart studs;

inlet means for supplying ink to said ink tray through said first wall at a first end of said ink tray;

outlet means for removing excess ink from said ink tray through said first wall at a second end of said ink tray;

a flow brake formed in said ink tray between said first wall and said first baffle such that ink introduced to said ink well through said inlet means is directed between said studs in said first baffle and between said channel ribs located to one side of said flow brake and therefrom along said second wall and between said channel ribs located to the other side of said flow brake to said outlet means.

5. An improved ink tray as claimed in claim 4 further including a plurality of second channel ribs having a generally elongated configuration formed on said bottom surface, said second channel ribs at their respective ends being spaced apart from first and second ones of said side walls, said first and second side walls being aligned opposite to each other, said second channel ribs being located to the other side of said flow brake.

6. An improved ink tray as claimed in claim 5 further including positioning means for maintaining the position of said ink pad in spaced relationship to said side walls and said first baffle.

7. An improved ink tray as claimed in claims 4, 5, or 6, further including means for restricting the absorption of ink by said ink pad.

* * * * *